US011358201B2

(12) United States Patent
Kinoshita

(10) Patent No.: US 11,358,201 B2
(45) Date of Patent: Jun. 14, 2022

(54) ROTARY PRESS DIE

(71) Applicant: YOUR BUSINESS CO., LTD., Hino (JP)

(72) Inventor: Tadatoshi Kinoshita, Hino (JP)

(73) Assignee: YOUR BUSINESS CO., LTD., Hino (JP)

( * ) Notice: Subject to any disclaimer, the term of this patent is extended or adjusted under 35 U.S.C. 154(b) by 279 days.

(21) Appl. No.: 16/619,153

(22) PCT Filed: Apr. 25, 2019

(86) PCT No.: PCT/JP2019/017798
§ 371 (c)(1),
(2) Date: Dec. 4, 2019

(87) PCT Pub. No.: WO2020/217430
PCT Pub. Date: Oct. 29, 2020

(65) Prior Publication Data

US 2021/0354185 A1 Nov. 18, 2021

(51) Int. Cl.

| | |
|---|---|
| ***B21D 19/08*** | (2006.01) |
| ***B21D 5/01*** | (2006.01) |
| ***B21D 37/01*** | (2006.01) |
| ***B21D 37/08*** | (2006.01) |

(52) U.S. Cl.
CPC ..... *B21D 19/086* (2013.01); *B21D 5/01* (2013.01); *B21D 37/01* (2013.01); *B21D 37/08* (2013.01)

(58) Field of Classification Search
CPC .... B21D 19/08; B21D 19/082; B21D 19/084; B21D 19/086; B21D 37/01; B21D 37/08; B21D 5/01; B21D 5/04
See application file for complete search history.

(56) References Cited

U.S. PATENT DOCUMENTS

| | | | | |
|---|---|---|---|---|
| 7,523,634 | B2 * | 4/2009 | Krozek | B21D 19/086 72/313 |
| 8,506,281 | B2 * | 8/2013 | Kinoshita | B21D 19/086 425/193 |

FOREIGN PATENT DOCUMENTS

JP 4597254 B1 12/2010

* cited by examiner

*Primary Examiner* — Teresa M Ekiert
(74) *Attorney, Agent, or Firm* — Locke Lord LLP

(57) ABSTRACT

A rotary press die has a rotating die forming a negative angle part on a plate-like work and a fixed die arranged outside the rotating die and forming a molding part except for the negative angle part on the work. The rotating die is a press molding die which is formed such that the press molding die rotates about a rotating axis when the work is removed and can be retracted inside the fixed die. A rotating block is configured by a fixed piece arranged on the fixing table and having a concave slide surface having the rotating axis as a center. A moving piece is arranged on the rotating die and having a convex slide surface which can slide on the concave slide surface by using the rotating axis as a center. An opening angle between the concave slide surface and the convex slide surface is 80° to 100°.

5 Claims, 8 Drawing Sheets

ROTARY PRESS DIE

TECHNICAL FIELD

The present invention relates to a rotary press die which rotates a cam and presses a panel-shaped work to form a negative angle part.

BACKGROUND ART

In a conventional technique, as the rotary press die described above, a rotary press die including a cylindrical rotary cam having the shape of a cylindrical body of rotation is known. The rotary press die is popularly used to form a negative angle part in an end portion of an automobile body panel.

The cylindrical rotary cam is generally a cylindrical member made of cast iron and is used such that the rotary cam is rotated in a cylindrical groove portion formed in a housing made of cast iron. A negative angle part is formed in a panel by press work between a part of the cylindrical rotary cam and another mold. The cylindrical rotary cam is rotated and moved away from the housing, and the worked panel can be easily removed.

However, the cylindrical rotary cam made of cast iron is disadvantageously hard to be worked in manufacturing. In particular, a large-sized cylindrical rotary cam cannot be worked by an ordinary lathe because of its large mass and requires a special large working machine. For example, a complex process in which portions arranged at both the ends of a work and used to grip the work are formed and cut out after the working must be performed. Similarly, a cylindrical groove portion of a housing is also hard to be worked.

In addition, since a press molding die using the cylindrical rotary cam is rotationally driven with a minimum (for example, about 0.02 mm) clearance in a cylindrical groove, the press molding die cannot smoothly operate even though the cylindrical rotary cam has a small distortion. Although an ordinary cylindrical rotary cam is quenched to secure its hardness, a distortion easily occurs in the cylindrical rotary cam due to the thermal process, and a rotational operation may not be operated due to the distortion.

The cylindrical rotary cam may be galled due to small dust. A gap (clearance) between the cylindrical rotary cam and the cylindrical groove portion is set to be small. For this reason, dust or the like entering this portion causes galling.

Furthermore, when working is performed by the rotary press die, the rotary press die may be unstable because of abrasion between the cylindrical rotary cam and the housing. However, since the rotary press die has no adjustable part, the cylindrical rotary cam and the cylindrical groove must be ground to correct the rotary press die, and the rotary press die is hard to be able to be corrected.

A rotary press die using a cylindrical rotary cam is disadvantageously hard to have a complex shape having a part varying diameter except for a cylindrical shape, and disadvantageously requires a large number of steps to form a groove for lubricating oil.

In order to solve the above problems, the present applicant proposed the following rotating structure of a body of rotation (see Patent Literature 1).

Patent Literature 1 describes a rotating structure for a body of rotation having a require width disposed in a press molding device including the rotating body, a main body portion located under the rotating body, and a rotating block attached to the rotating body and the main body portion, wherein the rotating block is configured by a convex piece attached to the lower part of the rotating body and a concave piece attached to the main body portion, the convex piece has a flat attaching portion and a convex sliding portion, bolt holes penetrating the attaching portion and the concave sliding portion are formed at a plurality of positions, the concave piece has a flat attaching portion and a concave sliding portion, bolt holes penetrating the attaching portion and the concave sliding portion are formed at a plurality of positions, the convex sliding portion and the concave sliding portion are arranged at slidable positions, projecting portions are formed at axis positions of the rotating body on both ends in a width direction of rotating body, a fall-preventing holding portion corresponding to a rotating locus of the rotating body is disposed with reference to the projecting portion, and an edge of the projecting portion moves along the fall-preventing holding portion according to rotation of the rotating body to prevent the rotating body from falling during reverse rotation of the rotating body.

CONVENTIONAL ART LITERATURE

Patent Literature

[Patent Literature 1] Japanese Patent No. 4597254

SUMMARY OF THE INVENTION

Problem to be Solved by the Invention

However, in the rotating structure for a body of rotation described in Patent Literature 1, the center of the rotating body is hard to be set, and a central position is difficult to be set at high accuracy. More specifically, the concave piece and the convex piece of the rotating block move in a horizontal direction perpendicular to the axis of the body of rotation, and the body of rotation is difficult to be arranged at an accurate position.

The present invention has been made in consideration of the above object and has as its object to provide a rotary press die in which a rotating center of a rotating die can be set at high accuracy.

Means for Solving the Problem

An invention described in claim 1 to solve the problem is a rotary press die including a rotating die forming a negative angle part on a plate-like work and a fixed die arranged outside the rotating die and forming a molding part except for the negative angle part on the work, wherein the rotating die is a press molding die which is formed such that the press molding die rotates about a rotating axis Or when the work is removed and can be retracted inside the fixed die, a rotating block which holds the rotating die such that the rotating die can be rotated about the rotating axis Or is disposed between a fixing table on which the rotating die is placed and the rotating die, the rotating block is configured by a fixed piece arranged on the fixing table and having a concave slide surface having the rotating axis Or as a center and a moving piece arranged on the rotating die and having a convex slide surface which can slide on the concave slide surface about the rotating axis Or, and an opening angle between the concave slide surface and the convex slide surface with reference to the rotating axis Or is set to falls within the range of 80 degrees to 100 degrees.

According to the present invention, in the rotating block rotatably holding the rotating die in the fixed die, since the opening angle between the concave slide surface of the fixed piece and the convex slide surface of the moving piece with reference to the rotating axis Or is set to fall within the range of 80 degrees to 100 degrees, the convex slide surface of the fixed piece and the concave slide surface of the moving piece contact with each other in a wide opening range, and large depths of the concave slide surface and the convex slide surface can be secured.

An invention described in claim 2 is also a rotary press die including a rotating die forming a negative angle part on a plate-like part and a fixed die arranged outside the rotating die and forming a molding part except for the negative angle part on the work, wherein the rotating die is a press molding die which is formed such that the press molding die rotates about a rotating axis Or when the work is removed and can be retracted inside the fixed die, a rotating block which holds the rotating die such that the rotating die can be rotated about the rotating axis Or is disposed between a fixing table on which the rotating die is placed and the rotating die, the rotating block is configured by a fixed piece arranged on the fixing table and having a concave slide surface having the rotating axis Or as a center and a moving piece arranged on the rotating die and having a convex slide surface which can slide on the concave slide surface about the rotating axis Or, and the convex slide surface of the moving piece is made of high-tensile brass.

According to the present invention, the convex slide surface of the moving piece is made of high-tensile brass which has a high strength and a high hardness without being thermally-treated even though the brass is still cast. Thus, the convex slide surface of the moving piece can have a high strength, a high hardness, and good lubricating property.

An invention described in claim 3 is also a rotary press die including a rotating die forming a negative angle part on a plate-like part and a fixed die arranged outside the rotating die and forming a molding part except for the negative angle part on the work, wherein the rotating die includes a rotating-side convex slide surface formed from a curved blade part forming the negative angle part on the work toward the fixed die side by using a central axis Os as an axis, the fixed die has a fixed-side concave slide surface formed at a position facing the rotating-side convex slide surface and formed by using the central axis Os as an axis, the central axis Os is set at a position different from that of the rotating axis Or of the rotating die, and the rotating-side convex slide surface and the fixed-side concave slide surface move in a direction away from each other when the rotating die rotates in a retreat direction.

According to the present invention, the central axis Os of the rotating-side convex slide surface of the rotating die and the fixed-side concave slide surface of the fixed die is set at a position different from the rotating axis Or of the rotating die, and the rotating-side convex slide surface and the fixed-side concave slide surface move in the direction away from each other when the rotating die rotates in the retreat direction.

An invention described in claim 4 is also a rotary process die wherein, in the rotary press die described in claim 3, the central axis Os is arranged on a location side on which the rotating die forms the negative angle part on the work with reference to the rotating axis Or.

According to the present invention, since the central axis Os of the rotating-side convex slide surface and the fixed-side concave slide surface is arranged on the location side on which the rotating die forms the negative angle part on the work with reference to the rotating axis Or, according to rotation of the rotating die, the rotating-side convex slide surface moves in a direction away from the fixed-side concave slide surface.

Advantageous Effect

According to the rotary press die according to the present invention, a center of rotation of the rotating die can be set at high accuracy.

More specifically, according to the rotary press die described in claim 1, in a rotating block rotatably holding the rotating die on the fixed die, since the opening angle between the concave slide surface of the fixed piece and the convex slide surface of the moving piece with reference to the rotating axis Or is set to fall within the range of 80 degrees to 100 degrees, the convex slide surface of the fixed piece and the concave slide surface of the moving piece contact with each other in a wide opening range, and large depths of the concave slide surface and the convex slide surface can be secured. Thus, the moving piece can move to keep an accurate central position with reference to the fixed piece. In addition, moving of the central position by external force decreases, and the center of rotation of the rotating die can be set at high accuracy.

According to the rotary press die described in claim 2, the convex slide surface of the moving piece is made of a high-tensile brass which has a high strength and a high hardness without being thermally treated even though the convex slide surface is still cast. Thus, the convex slide surface of the moving piece can have a high strength, a high hardness, and good lubricating property, and, furthermore, the concave slide surface of the moving piece can be worked at high accuracy.

According to the rotary press die described in claim 3, the central axis Os of the rotating-side convex slide surface of the rotating die and the fixed-side concave slide surface of the fixed die is set at at position different from that of the rotating axis Or of the rotating die, the rotating-side convex slide surface and the fixed-side concave slide surface move in a direction away from each other when the rotating die rotates in the retreat direction. For this reason, in the rotation of the rotating die upon the completion of press working of the work, the rotating-side convex slide surface and the fixed-side concave slide surface do not contact with each other, and movement can be smoothly performed.

Furthermore, according to the rotary press die described in claim 4, since the central axis Os of the rotating-side convex slide surface and the fixed-side concave slide surface is arranged on the location side on which the rotating die forms the negative angle part on the work with reference to the rotating axis Or of the rotating die, according to the rotation of the rotating die, the rotating-side convex slide surface moves in a direction away from the fixed-side concave slide surface. Thus, in the rotation of the rotating die upon the completion of press working of the work, the rotating-side convex slide surface and the fixed-side slide surface do not contact with each other, and movement can be smoothly performed.

BRIEF DESCRIPTION OF THE DRAWINGS

FIGS. 1A to 1C show a rotating die of a rotary press die according to a first embodiment of the present invention, in which FIG. 1A is a plan view of the rotating die, FIG. 1B is a front view of the rotating die, and FIG. 1C is a side view of the rotating die.

FIGS. 2A and 2B show the rotating die of a rotary press die according to the first embodiment of the present invention, in which FIG. 2A is a perspective view of the rotating die and FIG. 2B is a perspective view of the rotating die when viewed from a direction different from that in FIG. 2A.

FIGS. 3A and 3B show the rotating die of the rotary press die, in which FIG. 3A is a perspective view when viewed from a direction different from those in FIGS. 2A and 2B and FIG. 3B is a perspective view of the rotating die when viewed from a direction different from those in FIG. 3A and FIGS. 2A and 2B.

FIGS. 6A to 6C show a rotating block of the rotary press die, in which FIG. 6A is a perspective view showing an entire structure, FIG. 6B is a perspective view showing a fixed piece, and FIG. 6C is a perspective view showing a moving piece.

FIGS. 7A to 7D show an operation of the rotary press die, in which FIG. 7A is a sectional view of the rotary press die showing a state of a bottom dead point, FIG. 7B showing a state in which the rotary press die is rotated at 3 degrees, FIG. 7C showing a state in which the rotary press die is rotated at 6 degrees, and FIG. 7D showing a state in which the rotary press die is rotated at 12 degrees.

FIGS. 8A and 8B show a rotary press die according to a second embodiment of the present invention, in which FIG. 8A is a sectional view of the rotary press die in a press completion state and FIG. 8B is a sectional view in a work removing state.

EMBODIMENTS

A rotary press die according to a mode for carrying out the present invention will be described below with reference to the accompanying drawings.

The rotary press die according to an embodiment of the present invention press-works a panel-like work, e.g., an edge of a steel plate configuring an automobile body to form a negative angle part.

First Embodiment

Figure 1A:
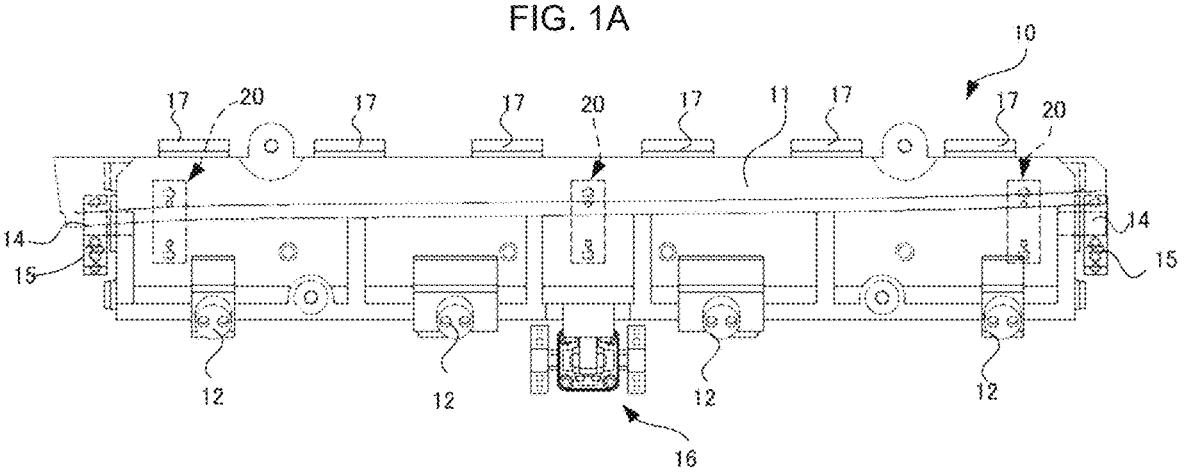
Figure 1B:
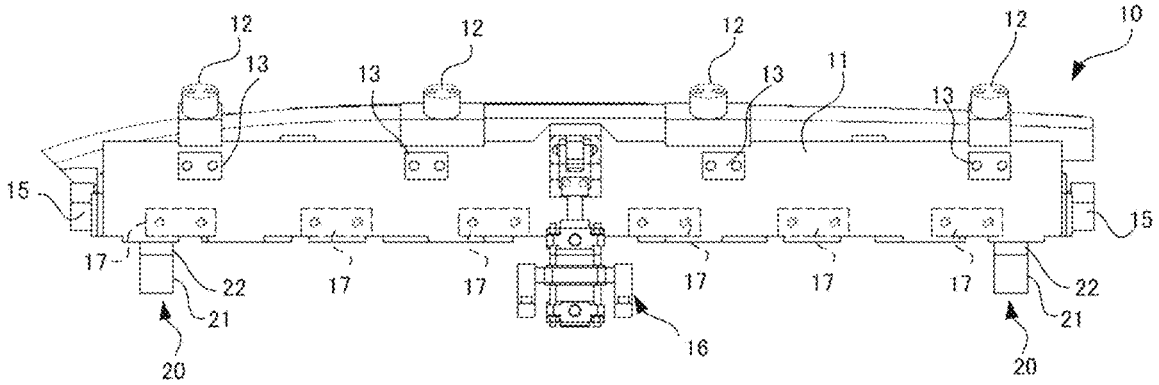
Figure 1C:
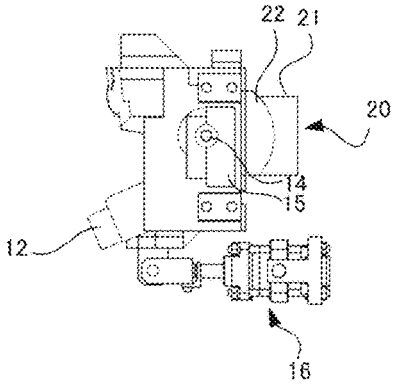
Figure 2A:
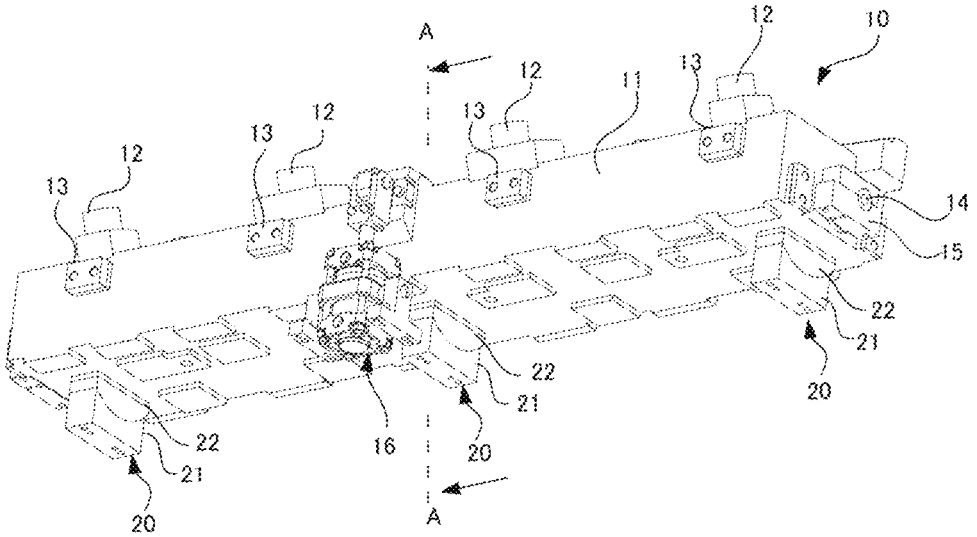
Figure 2B:
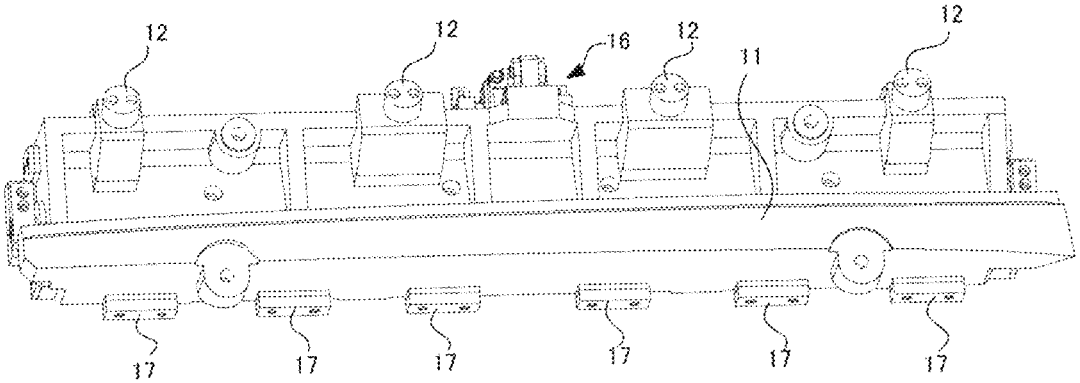
Figure 3A:
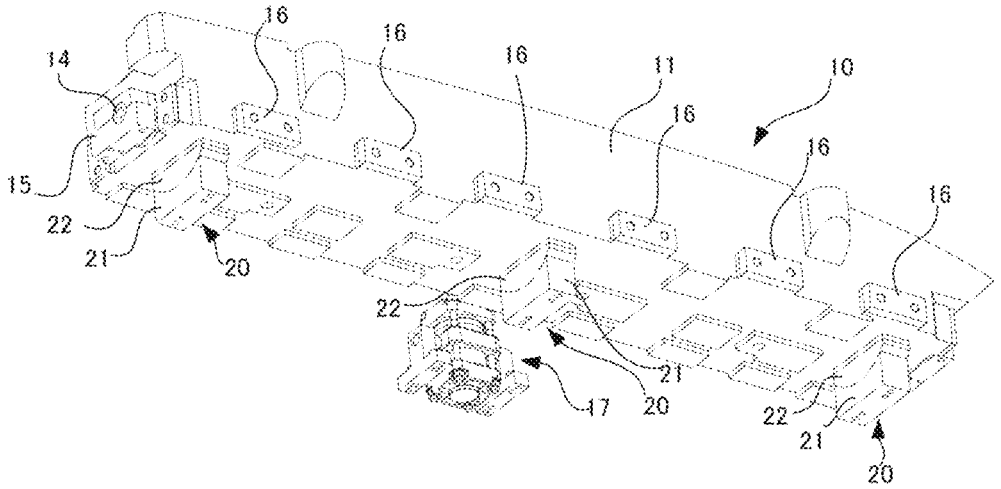
Figure 3B:
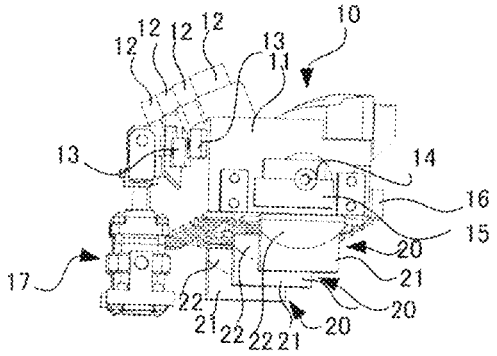

A first embodiment of the present invention will be described below. FIGS. 1A to 1C show a rotating die of a rotary press die according to a first embodiment of the present invention, in which FIG. 1A is a plan view of the rotating die of the first embodiment, FIG. 1B is a front view of the rotating die, and FIG. 1C is a side view of the rotating die, FIGS. 2A and 2B show the rotating die of a rotary press die according to the first embodiment of the present invention, in which FIG. 2A is a perspective view of the rotating die and FIG. 2B is a perspective view of the rotating die when viewed from a direction different from that in FIG. 2A, FIGS. 3A and 3B show the rotating die of the rotary press die, in which FIG. 3A is a perspective view when viewed from a direction different from those in FIGS. 2A and 2B and FIG. 3B is a perspective view of the rotating die when viewed from a direction different from those in FIG. 3A and FIGS. 2A and 2B, and FIG. 4 is a sectional view showing the configuration of the rotary press die and corresponding to an A-A line in FIG. 2A.

Figure 4:
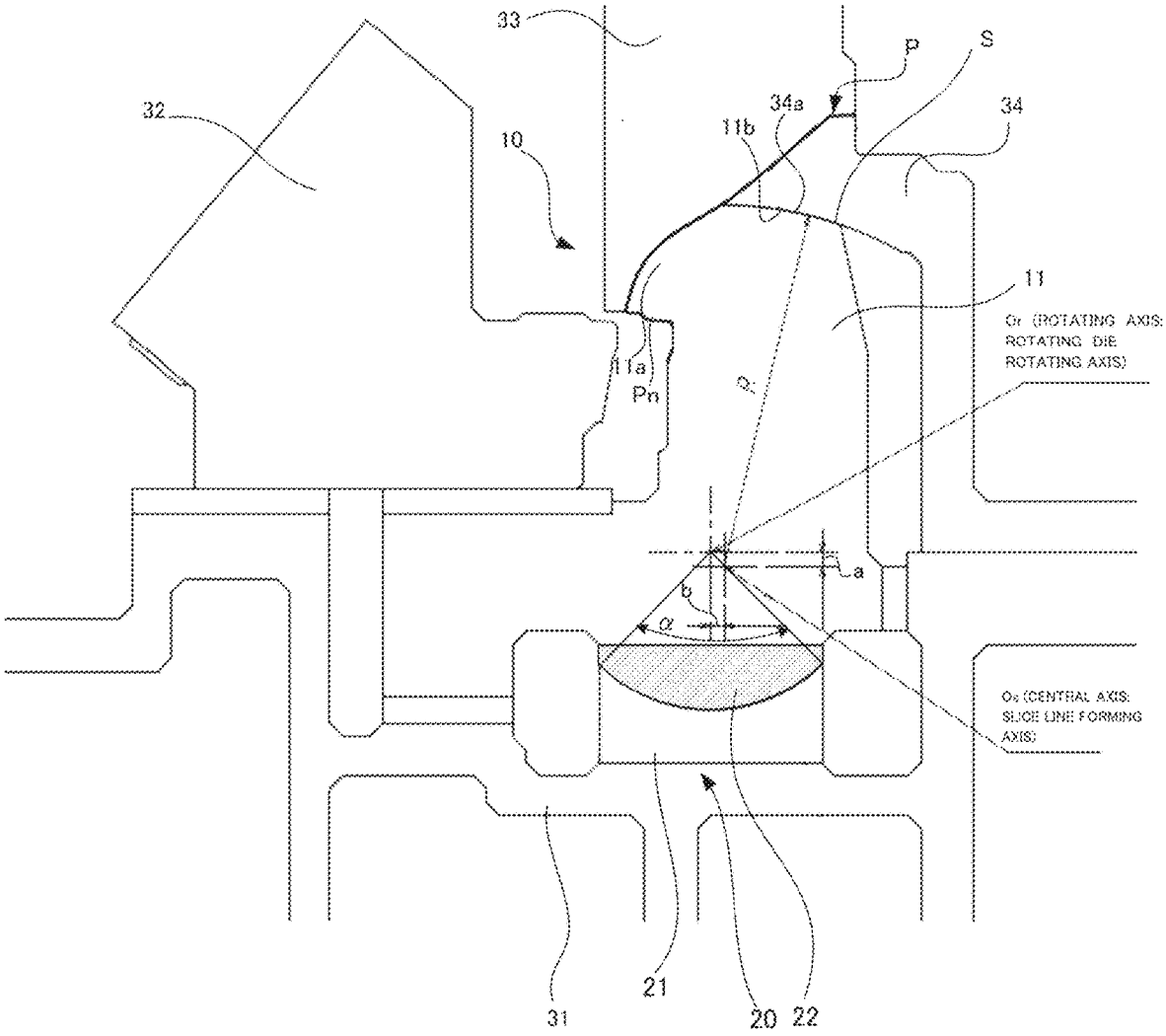
FIG. 4 is a sectional view showing the configuration of the rotary press die and corresponding to an A-A line in FIG. 2A.
Figure 5:
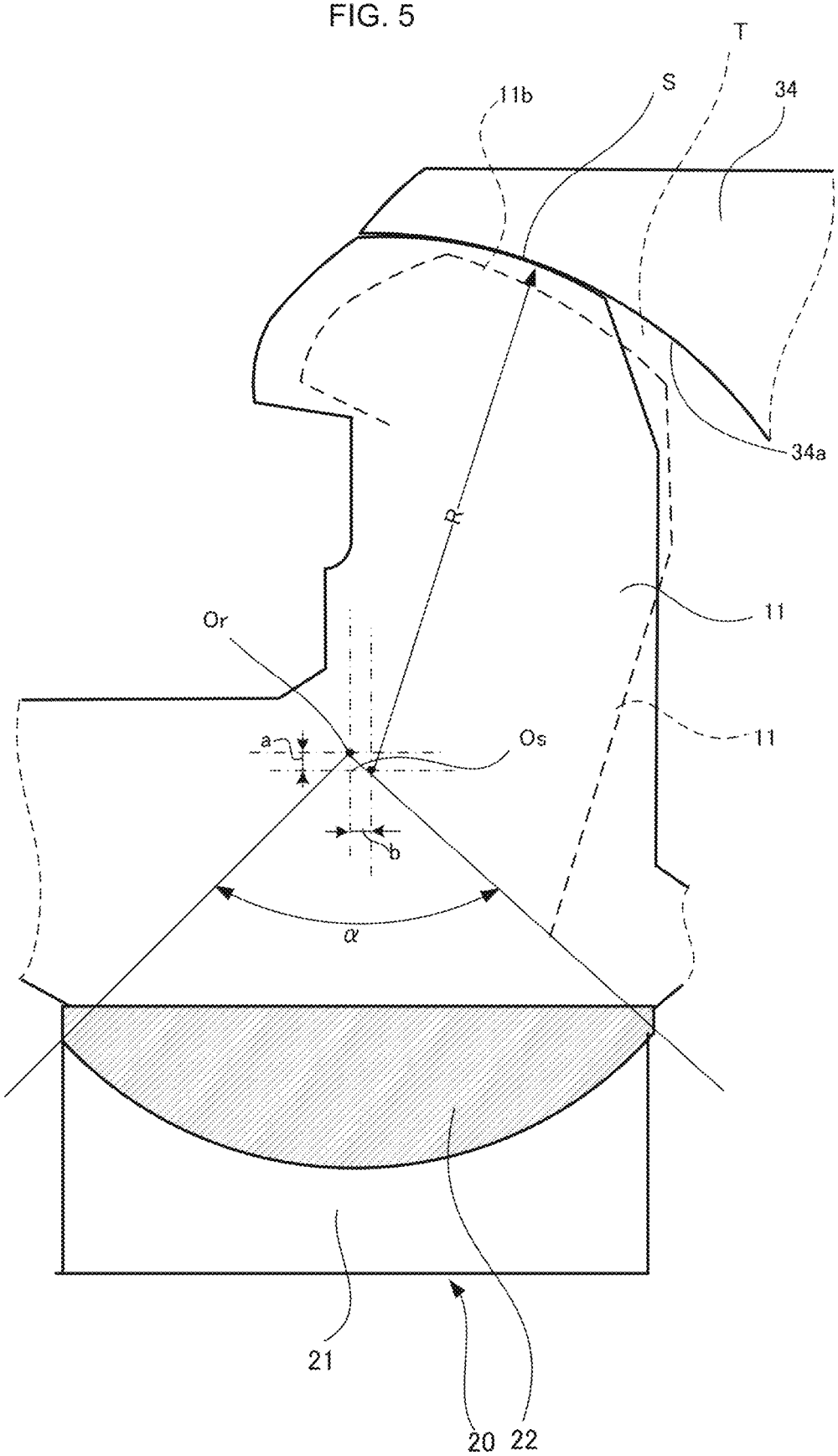
FIG. 5 is an enlarged sectional view showing a rotating block of the rotary press die and a slide surface between a rotating die and a fixed die.

A rotary press die 10, as shown in FIG. 4 and FIG. 5, fixes a rotating die 11 to a fixing table 31 through a rotating block 20, and rotationally drives the rotating die 11 to press-work a panel P with a fixed die 34, a horizontal moving cam 32, and a vertical moving cam 33, and forms a negative angle part Pn on the panel P. The rotating die 11 has a size large enough to press an end of a work.

In the rotary press die 10 according to the embodiment, as shown in FIG. 1 to FIG. 3, on the rotating die 11, a positioning distance block 12 and stopper plates 13 and 17 are arranged. The distance block 12 and the stopper plate 13 are disposed as needed. In addition, the rotating die 11 is arranged on a bearing 15 such that the rotating die 11 can be rotated by a driven-in shaft 14 and arranged by fixing the bearing 15 to the fixing table 31.

In this case, the distance block 12 determines a stroke amount of a cam, and the stopper plates 13 and 17 regulate a rotating position of the rotating die 11. These members are arranged as needed.

Between the rotating die 11 and the fixing table 31, as shown in FIG. 1 to FIG. 3, a plurality of (three, in this example) rotating blocks 20 rotatably supporting the rotating die 11 on the fixing table 31 are arranged. The rotating block 20 loads the load of the rotating die 11, and the rotating die 11 is rotatably held on the fixing table 31 without occurrence of distortion caused by its own weight or the like. The number of arranged rotating blocks 20 is selected as needed.

The rotating die 11 is rotationally driven at a predetermined angle about a rotating axis Or by driving an air cylinder 16. Although the driven-in shaft 14 positions the rotating die 11 by the rotating axis Or, the position of the rotating die 11 is accessorily determined. In an operation of the rotating die 11, the rotation of the rotating die 11 is held by the rotating blocks 20, the driven-in shaft 14 and the bearing 15 support the rotating die 11 when the rotating die 11 is not held by the rotating blocks 20 when the rotating die 11 is reversely rotated.

Figure 6A:
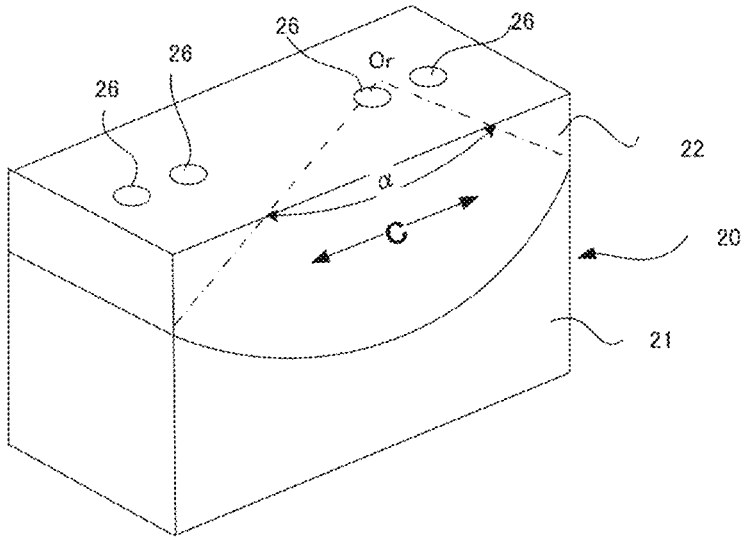
Figure 6B:
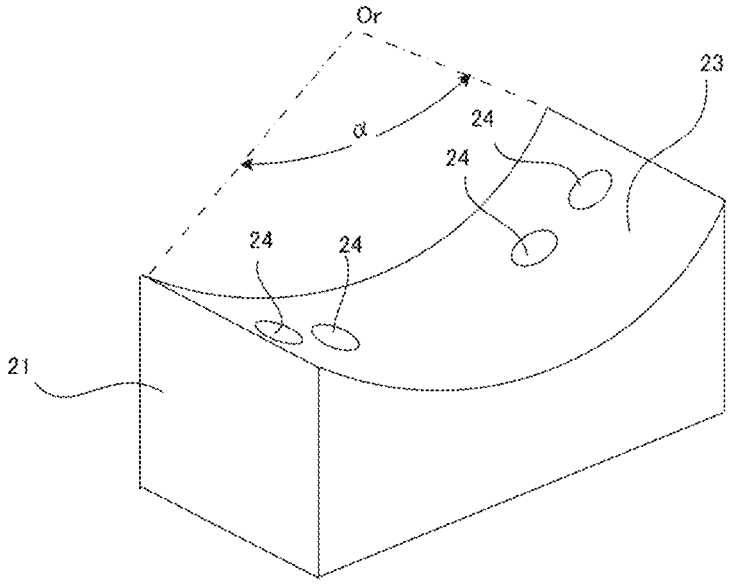
Figure 6C:
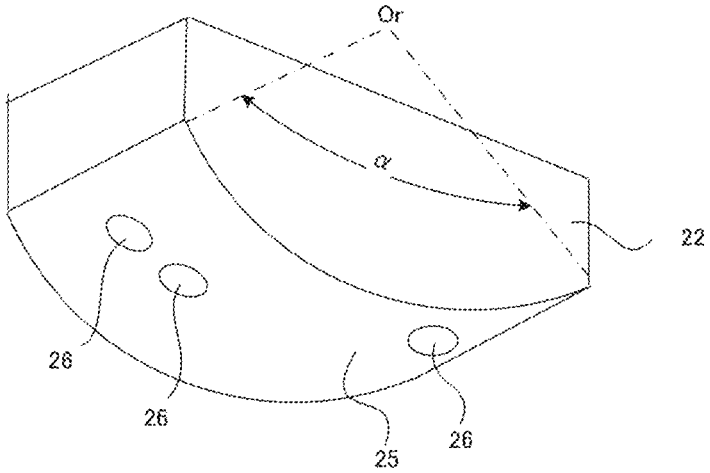

FIG. 5 is an enlarged sectional view showing a rotating block of the rotary press die and a slide surface between a rotating die and a fixed die, and FIGS. 6A to 6C show a rotating block of the rotary press die, in which FIG. 6A is a perspective view showing an entire structure, FIG. 6B is a perspective view showing a fixed piece, and FIG. 6C is a perspective view showing a moving piece. As shown in FIG. 5 and FIG. 6, in the rotary press die 10 according to the embodiment, the rotating blocks 20 are formed by a fixed piece 21 and a moving piece 22.

The fixed piece 21 is made of cast iron (FC). As shown in FIG. 6B, on the upper surface of the fixed piece 21, a concave slide surface 23 serving as a cylindrical surface which is concave downward and has the rotating axis Or corresponding to the driven-in shaft 14 of the rotating die 11 as an axis is formed. In the concave slide surface 23, a bolt hole 24 to fix the fixed piece 21 to the fixing table 31 is formed.

The moving piece 22 is formed as a block made of high-tensile brass. The high-tensile brass is an alloy containing, for example, copper (Cu) and zinc (Zn) as base materials and combined with aluminum (Al), iron (Fe), manganese (Mn), nickel (Ni), and the like, and is a material having high strength and a high hardness without being thermally treated even though the material is still cast. The high-tensile brass has strength (for example, 30 times) higher than that of cast iron and good lubricating property.

In the embodiment, as shown in FIG. 6C, on the lower surface of the moving piece 22, a convex slide surface 25 serving as a cylindrical surface which is convex downward and has the rotating axis Or as an axis is formed. In the convex slide surface 25, a bolt hole 26 to fix the moving piece 22 to the rotating die 11 is formed.

The fixed piece 21 is fixed to the fixing table 31, and the moving piece 22 is fixed to the rotating die 11 with bolt. At this time, adjusting thin plates (shims) are arranged between the fixed piece 21 and the fixing table 31 and between the moving piece 22 and the rotating die 11 to make it possible to finely adjust attaching positions of the parts. The fine adjustment can be performed to correct variations caused by distortion of each part and abrasion.

As shown in FIG. 5 and FIG. 6, in the embodiment, an opening angle α between the concave slide surface 23 of the fixed piece 21 and the convex slide surface 25 of the moving piece 22 with reference to the rotating axis Or are set to 90 degrees falling within the range of 80 degrees to 100 degrees. In this manner, even though some force acts on the rotating die 11, the moving piece 22 can be prevented from dropping out from the fixed piece 21. The slide surface increases by increasing the opening angle, and a weight per unit area decreases. The slide surface can receive larger force which can reduce friction.

According to an experiment by the present applicant, the opening angle α between the concave slide surface 23 of the fixed piece 21 and the convex slide surface 25 of the moving piece 22 with reference to the rotating axis Or is given by "x x" when the angle α is 60 degrees, given by "x" when the angle α is 70 degrees, given by "x" when the angle α is 75 degrees, given by "Δ" when the angle α is 80 degrees, given by "○ Δ" when the angle α is 85 degrees, and given by "○" when the angle α is 90 degrees. Here, the evaluation "x x" represents "absolutely disapproved", "x" represents "disapproved", "Δ" represents "approved", "○ Δ" represents "good", and "○" represents "excellent".

According to the experiment result, the angle α between the concave slide surface 23 and the convex slide surface 25 with reference to the rotating axis Or must be 80 degrees or more. In addition, when the opening angle α exceeds 100 degrees, an effect of preventing the fixed piece 21 from the moving piece 22 when the angle α exceeds 100 degrees does not increase, and the angle α which exceeds 100 degrees is not real because costs of materials and manufacturing are high.

The rotating block 20 used in the embodiment is good in strength and lubricating property because the moving piece 22 is made of high-tensile brass. For this reason, an oil groove need not be formed unlike in a conventional rotating die made of cast iron. The high-tensile brass can be mechanically worked at high accuracy.

In order to improve the lubricating property of the rotating block 20, a solid lubricant agent, for example, graphite can be buried in the concave slide surface 23 of the fixed piece 21 and the convex slide surface 25 of the moving piece 22. In this manner, the contact surface can be prevented from being galled without supplying oil.

Positional adjustment of the rotating axis Or of the rotating die 11 can be easily performed by interposing an adjusting thin plate (shim) between the fixed piece 21 and the fixing table 31 of the rotating block 20 or the moving piece 22 and the rotating die 11.

The shape of a slice surface S serving as a slide surface between the rotating die 11 and the fixed die 34 and the position of the rotating axis Or of the rotating die 11 will be described below.

As shown in FIG. 4 and FIG. 5, on the rotating die 11, a rotating-side convex slide surface 11*b* is continuously formed on a curved blade part 11*a* forming a negative angle part Pn on the panel P serving as a work. the rotating-side convex slide surface 11*b* is a curved surface which is convex toward the fixed die 34 side and has a radius R1 having a central axis Os as an axis.

On the fixed die 34, a fixed-side concave side surface 34*a* facing the rotating-side convex slide surface 11*b* is formed. The fixed-side concave side surface 34*a* is a curved surface which is concave toward the outside and has a radius R2 having the central axis Os as an axis. Actually, since the rotating-side convex slide surface 11*b* and the fixed-side concave side surface 34*a* do not contact with each other, R1<R2 is set. Here, the following explanation will be executed on the assumption that a dividing surface between the rotating die 11 and the fixed die 34 is called the slice surface S, the axis of the slice surface S is called the central axis Os, and the radius is R.

In this configuration, in the rotary press die 10 according to the embodiment, the central axis Os is arranged at a position different from that of the rotating axis Or of the rotating die 11, for example, the rotating axis Or is arranged on the curved blade part 11*a* side forming the negative angle part of the rotating die 11 with reference to the central axis Os. In this manner, as shown in FIG. 5, when the rotating die 11 rotates in a retreat direction, the rotating-side convex slide surface 11*b* and the fixed die 34 moves away from each other to form a gap T. In FIG. 5, the gap T between the rotating-side convex slide surface 11*b* and the fixed-side concave side surface 34*a* is largely drawn with exaggeration.

For this reason, in the rotary press die 10 according to the embodiment, after the press working, when the rotating die 11 is rotated to remove the panel P, the rotating-side convex slide surface 11*b* and the fixed-side concave side surface 34*a* move in the direction away from each other. Thus, a smooth operation can be performed without occurrence of contact and friction between the rotating die 11 and the fixed die 34.

This example shows a state in which R=200 mm and the rotating axis Or is deviated upward by a (for example, 10 mm) and deviated to the left by b (for example, 10 mm) from the central axis Os. This position may be a position having a height equal to that of, for example, the central axis Os. The positional relationship between both the axes can be arbitrarily changed as needed.

According to the experiment by the present applicant, it is found that, when R=100 mm to R=almost 200 mm, a deviation of the central axis Os from the rotating axis Or is preferably about 10 mm, and a large functional change does not occur even though the deviation is 5 mm. Note that, when the deviation is made excessively large, the fixed die 34 becomes thin.

Figure 7A:
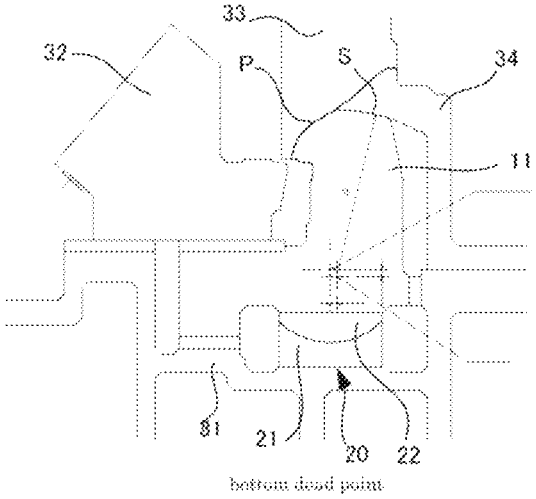
Figure 7B:
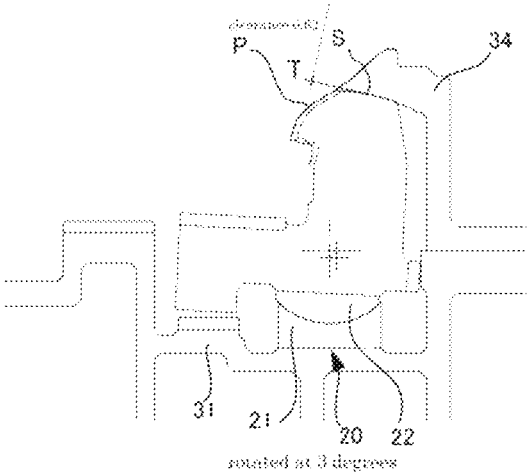
Figure 7C:
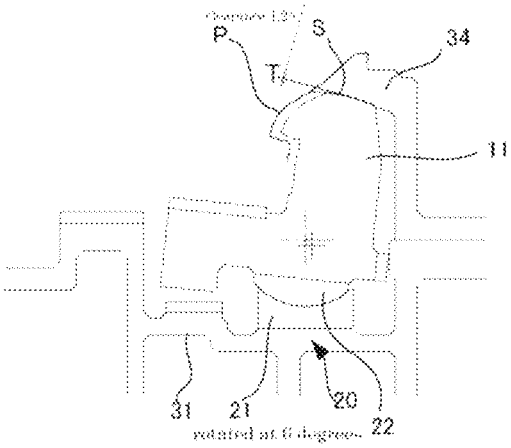
Figure 7D:
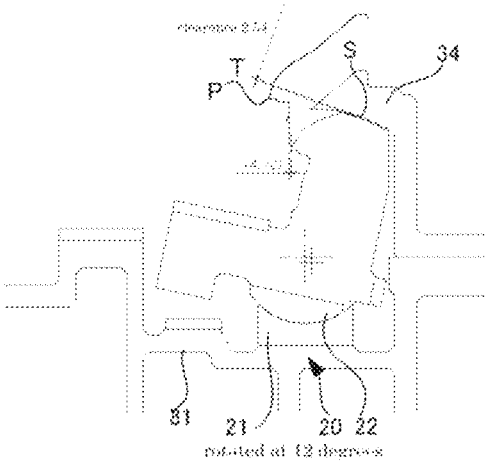

An operation of removing the panel P by rotating the rotating die 11 from a state in which the panel P is pressed by the rotary press die 10 to form a negative angle part will be described below. FIGS. 7A to 7D show an operation of the rotary press die, in which FIG. 7A is a sectional view of the rotary press die showing a state of a bottom dead point, FIG. 7B showing a state in which the rotary press die is rotated at 3 degrees, FIG. 7C showing a state in which the rotary press die is rotated at 6 degrees, and FIG. 7D showing a state in which the rotary press die is rotated at 12 degrees.

As shown in FIG. 7A, pressing of the panel P is completed. The rotating die 11 is sequentially rotated as shown in FIGS. 7B, 7C, and 7D. At this time, a gap T (clearance) between the rotating die 11 and the fixed die 34 sequentially increases in the order shown in FIG. 7B, FIG. 7C, and FIG. 7D, i.e., 0.62 mm in FIG. 7B, 1.25 mm in FIG. 7C, and 2.54 mm in FIG. 7D. In this manner, is found that the rotating die 11 can smoothly move without contacting with the fixed die 34.

As described above, according to the rotary press die 10 of the embodiment, the convex slide surface 25 of the fixed piece 21 and the concave slide surface 23 of the moving piece 22 contact with each other in a wide opening range, and, large depths of the concave side surface and the convex slide surface can be secured. The moving piece can be moved with an accurate central position with reference to the fixed piece. A moving distance of the central position by external force is small. For this reason, the rotating center of the rotating die can be set at high accuracy.

Furthermore, according to the rotary press die 10 of the embodiment, since the moving piece 22 is made of high-tensile brass, the moving piece 22 can have high strength, a high hardness, and good lubricating property. In addition, the concave slide surface of the moving piece 22 can be worked at high accuracy, the rotation by the rotating block 20 can be smoothly performed.

The central axis Os of the rotating-side convex slide surface of the rotating die and the fixed-side concave slide surface of the fixed die is set at a position different from that of the rotating axis Or of the rotating die, i.e., on the curved blade part 11*a* side on which a negative angle part is formed by the rotating die 11 with reference to the rotating axis Or of the rotating die, and the rotating-side convex slide surface 11*b* and the fixed-side concave side surface 34*a* move in a direction away from each other to have the gap T when the rotating die 11 is rotated in a retreat direction. For this reason, in rotation of the rotating die 11 on completion of press working, the rotating die 11 can be smoothly moved without contacting the rotating-side convex slide surface 11*b* and the fixed-side concave slide surface 34*a* with each other.

The above example explains that the moving piece 22 is entirely made of high-tensile brass. However, only a portion near the convex slide surface 25 of the moving piece 22 is able to be made of high-tensile brass. A portion near the concave slide surface 23 of the fixed piece 21 or the entire fixed piece 21 may be made of high-tensile brass.

Second Embodiment

Figure 8A:
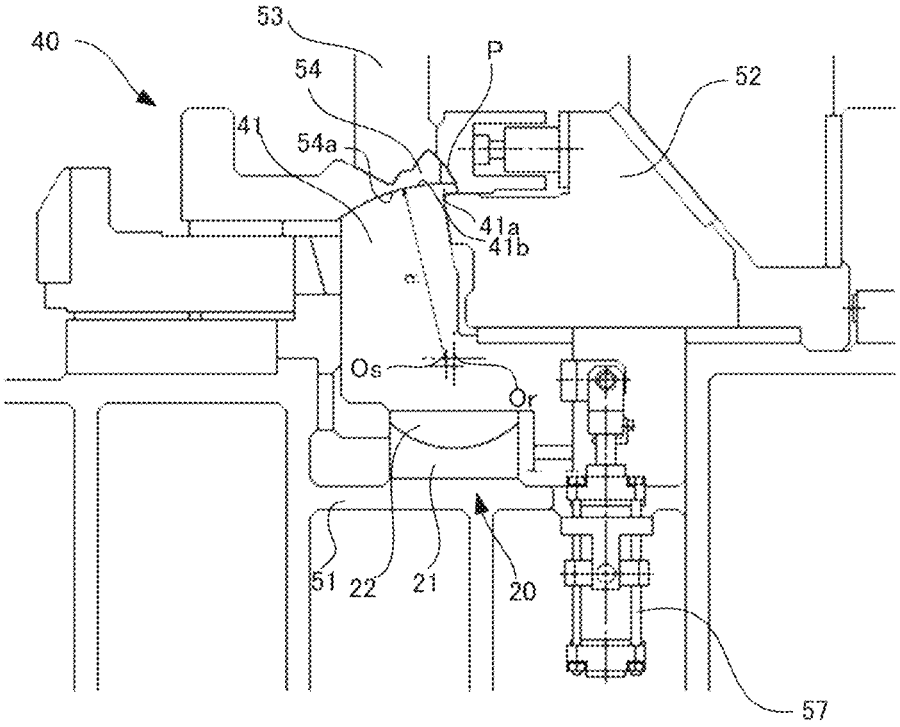
Figure 8B:
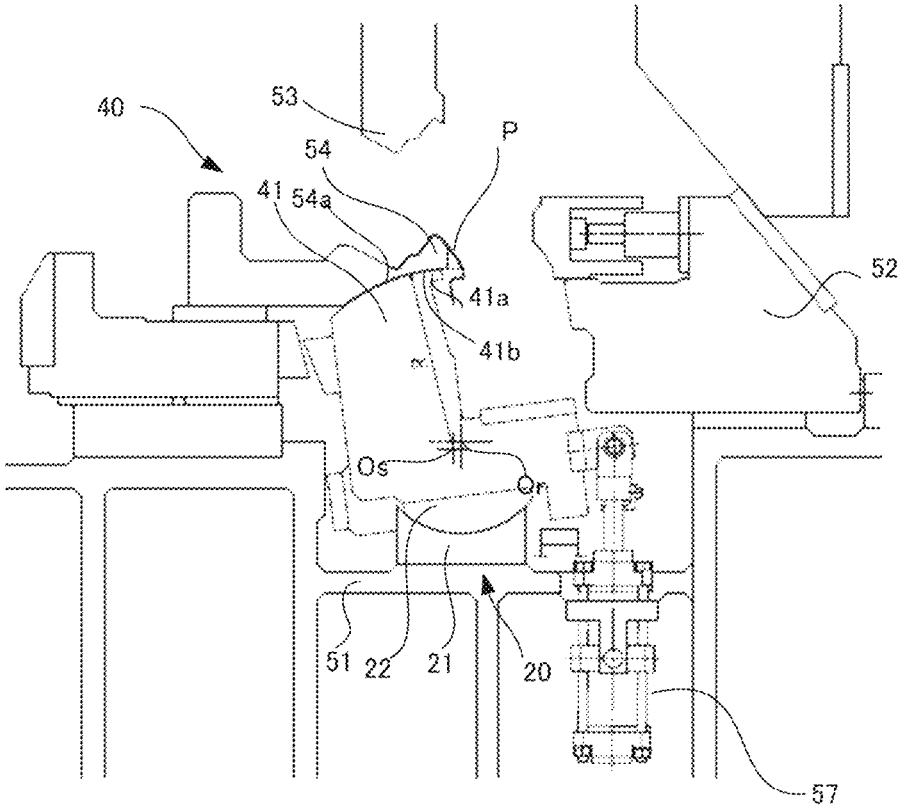

A rotary press die according to a second embodiment of the present invention will be described below. FIGS. 8A and 8B show a rotary press die according to a second embodiment of the present invention, in which FIG. 8A is a sectional view of the rotary press die in a press completion state and FIG. 8B is a sectional view in a work removing state.

A rotary press die 40 according to the embodiment forms a panel P having a shape different from that in the first embodiment. For this reason, in the rotary press die 40, the shape of a rotating die 41, the shapes of a horizontal moving cam 52, a vertical moving cam 53, and a fixed doe 54, and the like are different from those in the first embodiment. However, the second embodiment has the same basic configuration as that in the first embodiment.

This example uses the same rotating block 20 as that in the rotary press die according to the first embodiment in the rotating die 41. More specifically, in the first embodiment, the rotating block 20 is arranged between the rotating die 41 and a fixing table 51, and the rotating die 41 can rotated by using the rotating axis Or as an axis.

The configuration of the rotating block 20 is the same as that in the first embodiment. More specifically, as shown in FIG. 8A, the rotating block 20 is configured by the fixed piece 21 having the concave slide surface 23 and the moving piece 22 having the convex slide surface 25. An opening angle of the concave slide surface 23 and the convex slide surface 25 with reference to the rotating axis Or is set to 90 degrees. The moving piece 22 is made of high-tensile brass.

Furthermore, a rotating-side convex slide surface 41*b* of the rotating die 41 and a fixed-side concave slide surface 44*a* of the fixed piece 54 form a slice surface S, and a central axis Os of the slice surface S is arranged at a position different from that of the rotating axis Or. More specifically, R=200 mm is established, and the rotating axis Or is deviated to a curved blade part 41*a* side on which a negative angle part of the rotating die 41 is formed with reference to the central axis Os, i.e., deviated upward by a (for example, 10 mm) and deviated to the right by b (for example, 10 mm).

In this manner, the rotary press die 40 according to the embodiment, as shown in FIGS. 8A and 8B, as in the first embodiment, the moving piece can move with an accurate central position with reference to the fixed piece. A moving distance of the central position by external force is small. For this reason, the rotating center of the rotating die can be set at high accuracy.

According to the rotary press die 40 of the second embodiment, as shown in FIG. 8B, in rotation of the rotating die 41 upon completion of press working, the rotating die 41 can be smoothly moved without contacting the rotating-side convex slide surface 41*b* and the fixed-side concave slide surface 54*a* with each other.

In each of the embodiments, the rotating die is configured to be supported by the rotating block and to be rotated. However, in a so-called swing type which does not use such a rotating block, when a slice surface S is formed on the rotating-side convex slide surface and the fixed-side concave slide surface, the central axis Os of the slice surface S is arranged at a position different from that of the rotating axis Or to make it impossible to contact the rotating-side convex slide surface with the fixed-side concave slide surface.

INDUSTRIAL APPLICABILITY

Since the rotary press die according to the present invention can set a rotating center of the rotating die at high accuracy, the rotary press die has industrial applicability on automotive manufacture.

REFERENCE NUMERALS

10: rotary press die
11: rotating die
11*a*: curved blade part forming negative angle part
11*b*: rotating-side convex slide surface
12: distance block
13: stopper plate
14: drive-in shaft
15: bearing
16: air cylinder
17: stopper plate
20: rotating block
21: fixed piece
22: moving piece
23: concave slide surface
24: bolt hole
25: convex slide surface
26: bolt hole
31: fixing table
32: horizontal moving cam
33: vertical moving cam
34: fixed die
34*a*: fixed-side concave slide surface
40: rotary press die
41: rotating die
41*a*: curved blade part forming negative angle part

41*b*: rotating-side convex slide surface
44*a*: fixed-side concave slide surface
51: fixing table
52: horizontal moving cam
53: vertical moving cam
54: fixed die
54*a*: fixed-side concave slide surface
Or: rotating axis
Os: central axis
P: panel
Pn: negative angle part
S: slice surface
T: gap
α: opening angle

The invention claimed is:

1. A rotary press die comprising a rotating die forming a negative angle part on a plate-shaped work and a fixed die arranged outside the rotating die and forming a molding part except for the negative angle part on the work, wherein the rotating die includes a rotating-side convex slide surface and is a press molding die which is formed such that the press molding die rotates about a rotating axis (Or) when the work is removed and can be retracted inside the fixed die, and a rotating block which holds the rotating die such that the rotating die can be rotated about the rotating axis (Or) is disposed between a fixing table on which the rotating die is placed and the rotating die, the rotating block comprising:

a fixed piece arranged on the fixing table and having a concave slide surface having the rotating axis (Or) as a center, and a moving piece arranged on the rotating die and having a convex slide surface which can slide on the concave slide surface by using the rotating axis (Or) as a center, wherein an opening angle between the concave slide surface and the convex slide surface with reference to the rotating axis (Or) is set to fall within the range of 80 degrees to 100 degrees.

2. The rotary press die according to claim 1, wherein the fixed die has a fixed-side concave slide surface formed at a position facing the rotating-side convex slide surface and formed by using a central axis (Os) as an axis of the fixed-side concave slide surface, the central axis (Os) is set at a position different from that of the rotating axis (Or) of the rotating die.

3. A rotary press die comprising a rotating die forming a negative angle part on a plate-shaped work and a fixed die arranged outside the rotating die and forming a molding part except for the negative angle part on the work, wherein the rotating die includes a rotating-side convex slide surface and is a press molding die which is formed such that the press molding die rotates about a rotating axis (Or) when the work is removed and can be retracted inside the fixed die, the fixed die has a fixed-side concave slide surface formed at a position facing the rotating-side convex slide surface and formed by using a central axis (Os) as an axis of the fixed-side concave slide surface, the central axis (Os) is set at a position different from that of the rotating axis (Or) of the rotating die, and a rotating block which holds the rotating die such that the rotating die can be rotated about the rotating axis (Or) is disposed between a fixing table on which the rotating die is placed and the rotating die, the rotating block comprising a fixed piece arranged on the fixing table and having a concave slide surface having the rotating axis (Or) as a center and a moving piece arranged on the rotating die and having a convex slide surface which can slide on the concave slide surface about the rotating axis (Or), wherein the convex slide surface of the moving piece is made of high-tensile brass.

4. A rotary press die comprising a rotating die forming a negative angle part on a plate-shaped work and a fixed die arranged outside the rotating die and forming a molding part except for the negative angle part on the work, wherein the rotating die includes a rotating-side convex slide surface formed from a curved blade part forming the negative angle part on the work toward the fixed die side by rotating about a rotating axis (Or), the fixed die has a fixed-side concave slide surface formed at a position facing the rotating-side convex slide surface and formed by using a central axis (Os) as an axis of the fixed-side concave slide surface, the central axis (Os) is set at a position different from that of the rotating axis (Or) of the rotating die, and the rotating-side convex slide surface and the fixed-side concave slide surface move in a direction away from each other when the rotating die rotates in a retreat direction.

5. The rotary press die according to claim 4, wherein the rotary axis (Or) is arranged on a part side on which the rotating die forms the negative angle part on the work with reference to the central axis (Os).

* * * * *